US006860755B2

(12) United States Patent
Wang et al.

(10) Patent No.: US 6,860,755 B2
(45) Date of Patent: Mar. 1, 2005

(54) BUS CABLE CONNECTOR HAVING TERMINAL TAIL SECTIONS POSITIONED BY RIBS

(75) Inventors: Pai-Chuan Wang, Taipei (TW); Yau-Hsuan Liu, Taipei Hsien (TW)

(73) Assignee: Hung-Jen Chiu, Taipei Hsien (TW)

( * ) Notice: Subject to any disclaimer, the term of this patent is extended or adjusted under 35 U.S.C. 154(b) by 50 days.

(21) Appl. No.: 10/418,153

(22) Filed: Apr. 18, 2003

(65) Prior Publication Data

US 2003/0181094 A1 Sep. 25, 2003

Related U.S. Application Data

(63) Continuation-in-part of application No. 09/991,677, filed on Nov. 26, 2001, now abandoned.

(30) Foreign Application Priority Data

Sep. 12, 2001 (TW) ..... 090215659

(51) Int. Cl.[7] ..... H01R 13/00
(52) U.S. Cl. ..... 439/498; 439/492; 439/494
(58) Field of Search ..... 439/498, 492, 439/494, 502, 912, 497, 405, 404, 604, 857, 668, 60

(56) References Cited

U.S. PATENT DOCUMENTS

| | | | | | |
|---|---|---|---|---|---|
| 3,907,396 | A | * | 9/1975 | Huber | 439/472 |
| 4,035,050 | A | * | 7/1977 | Volinskie | 439/397 |
| 4,094,564 | A | * | 6/1978 | Cacolici | 439/456 |
| 4,278,314 | A | * | 7/1981 | Moser et al. | 439/404 |
| 4,311,356 | A | * | 1/1982 | Levitt | 439/405 |
| 4,323,295 | A | * | 4/1982 | Davis, Jr. | 439/465 |
| 4,508,403 | A | * | 4/1985 | Weltman et al. | 439/502 |

* cited by examiner

*Primary Examiner*—Jean F. Duverne
(74) *Attorney, Agent, or Firm*—Lowe Hauptman Gilman & Berner, LLP

(57) ABSTRACT

An insulative body for producing two kinds of terminal modules is disclosed. The insulative body is moldable over two kinds of terminals sets, and has one end face formed with spaced apart parallel ribs confining grooves therebetween. Each terminals set includes two rows of terminals having retention sections surrounded by the insulative body, and tail sections extending out of the end face of the body such that the ribs and grooves extend between two rows of the tail sections. In one kind of the terminals sets, two rows of the tail sections include bent sections spaced from each other by the ribs and converging toward a plane, and soldering sections coplanar in the plane. In another terminals set, the tail sections are bent at right angle and are received in the respective grooves to be soldered to respective wires.

5 Claims, 10 Drawing Sheets

BUS CABLE CONNECTOR HAVING TERMINAL TAIL SECTIONS POSITIONED BY RIBS

CROSS-REFERENCE TO RELATED APPLICATION

This application is also a continuation-in-part of U.S. patent application Ser. No. 09/991,677 filed by the applicant on Nov. 26, 2001 abandoned, the entire disclosure of which is incorporated herein by reference.

BACKGROUND OF THE INVENTION

This application claims priority of Taiwanese Application No. 090215659 filed on Sep. 12, 2001.

1. Field of the Invention

This invention relates to an electrical connector, more particularly to a bus cable connector including an insulative body molded over a set of terminals and having an end face formed with parallel grooves and ribs.

2. Description of the Related Art

With the fast development of the information industry, use of a large amount of storage devices is becoming popular. The transmission and communication of data in the hardware requires use of bus cable connectors. FIGS. 1 and 2 show a typical cable connector which includes two rows of terminals 110 installed within a connector housing 100 for electrical connection with a cable 120 including paired wires 140. The paired wires 140 are originally twisted within a sheathing 130 and are untwisted into individual wires so as to be positioned on two adhesive tapes 150 in an order corresponding to that of the respective terminals 110 which are aligned in two rows. In order to match the two rows of terminals 110, each pair of wires 140 have to be separated to be attached respectively to the two adhesive tapes 150. The wires 140 attached to the upper adhesive tape 150 are soldered to the respective terminals 110 in the upper row, whereas the wires 140 attached to the lower adhesive tape 150 are soldered to the respective terminals 110 in the lower row. If all of the wires 140 are to be arranged in a single row on a single adhesive tape, it is desirable that the soldering sections of terminals 110 be aligned in a same plane.

SUMMARY OF THE INVENTION

An object of the present invention is to provide a cable connector having two rows of terminals with soldering sections aligned in a same plane for electrical connection with wires of a cable, thus eliminating the need to separate paired wires of a cable into two rows.

Another object of the present invention is to provide one form of insulative body which can be insert-molded over either one of two types of terminals sets for producing two different terminal modules, thereby permitting the use of a common mold for producing different terminal modules.

According to one aspect of the present invention, a cable connector comprises: a cable having a plurality of wires; a connector housing; and a terminal module mountable on the connector housing to establish an electrical connection with the wires, the terminal module including an insulative body having two opposed first and second faces, and a plurality of spaced apart parallel ribs formed in the first face and confining grooves therebetween, the insulative body being molded over two rows of terminals, the terminals each including a retention section surrounded by the insulative body, and a tail section extending out of the insulative housing through the first face, the parallel ribs and grooves extending between the tail sections of the two rows, the grooves having first ends on the same side and second ends opposite to the first ends, wherein the tail sections of the terminals include bent sections extending respectively from the retention sections, and soldering sections extending respectively from the bent sections and being coplanar with each other in a same plane, the soldering sections being soldered respectively to the wires, the bent sections having proximal ends adjacent to the first face and distal ends extending away from the first face and connected to the soldering sections, all of the bent sections converging from the proximal ends to the plane of the soldering sections, the proximal ends of the bent sections in one of the rows and the proximal ends of the bent sections in the other one of the rows alternately passing through the first and second ends of the grooves, every other one of the first ends of the grooves receiving one of the proximal ends of the terminals of one of the rows, every other one of the second ends of the grooves receiving one of the proximal ends of the terminals in the other row, the proximal ends of the bent sections being spaced from each other by the ribs.

In another aspect of the present invention, a cable connector comprises a terminal module which includes a terminals set and an insulative body molded over the terminals set through an insert molding process, the insulative body having two opposed first and second faces, and a plurality of spaced apart parallel ribs formed in the first face and confining grooves therebetween, the terminals set being selected from a group consisting of a first terminals set and a second terminals set, each of the first and second terminals sets having two rows of terminals, the terminals including retention sections surrounded by the insulative body, and tail sections respectively extending from the retention sections, the tail sections extending out of the insulative body from the first face, the parallel ribs and grooves extending between the two rows of the tail sections, the grooves having first ends on the same side and second ends opposite to the first ends; wherein the tail sections of the first terminal set include bent sections extending respectively from the retention sections, and soldering sections extending respectively from the bent sections and being coplanar with each other in a same plane, the bent sections having proximal ends adjacent to the first face and distal ends extending away from the first face and connected to the soldering sections, all of the bent sections converging from the proximal ends to the plane of the soldering sections, the proximal ends of the bent sections in one of the rows and the proximal ends of the bent sections in the other one of the rows alternately passing through the first and second ends of the grooves, every other one of the first ends of the grooves receiving one of the proximal ends of the terminals of one of the rows, every other one of the second ends of the grooves receiving one of the proximal ends of the terminals of the other row, the proximal ends of the bent sections being spaced from each other by the ribs, wherein the two rows of the tail sections of the second terminals set are bent substantially at right angles and are alternatively received in the grooves.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
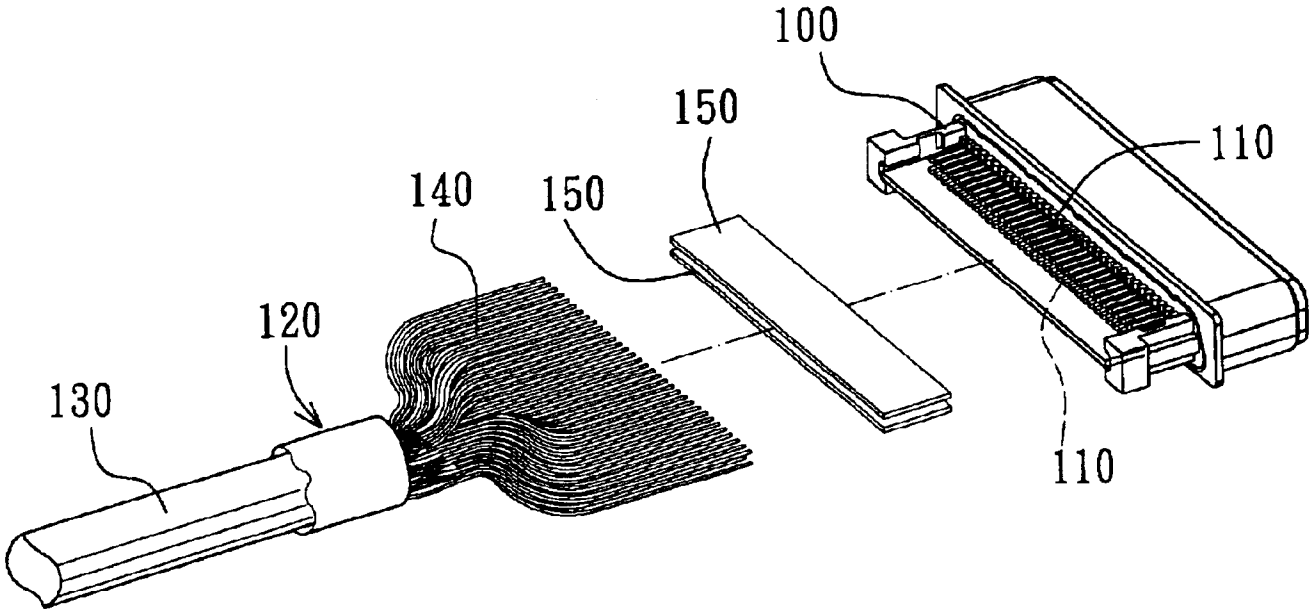
FIG. 1 PRIOR ART
FIG. 1 is an exploded view of the prior art.
Figure 2:
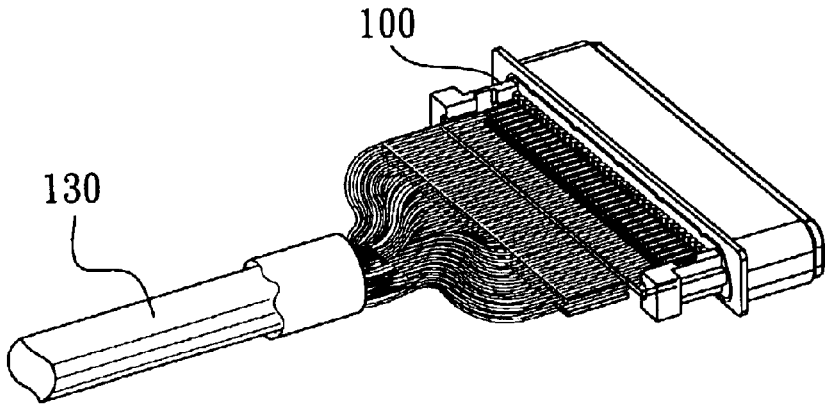
F I G. 2 PRIOR ART
FIG. 2 is a perspective view of the prior art.
Figure 3:
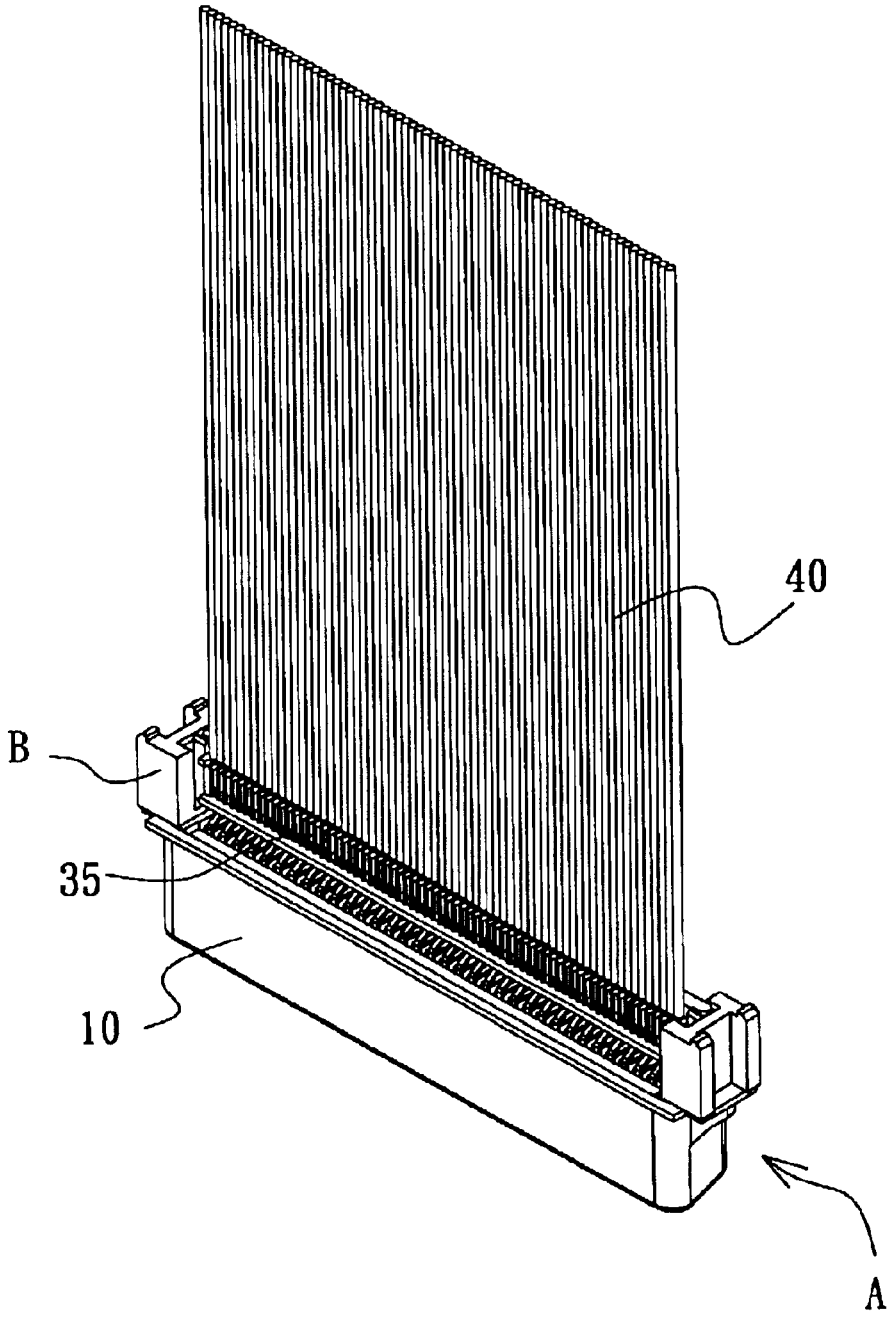
FIG. 3 is a perspective view of a cable connector embodying the present invention.
Figure 4:
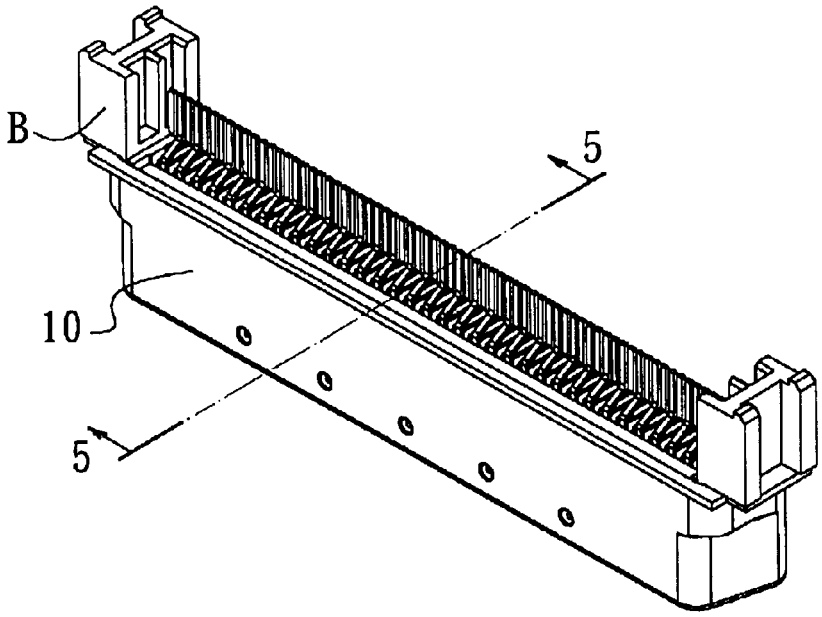
FIG. 4 is a perspective view of a terminal module mounted inside a connector housing shown in FIG. 3.
Figure 5:
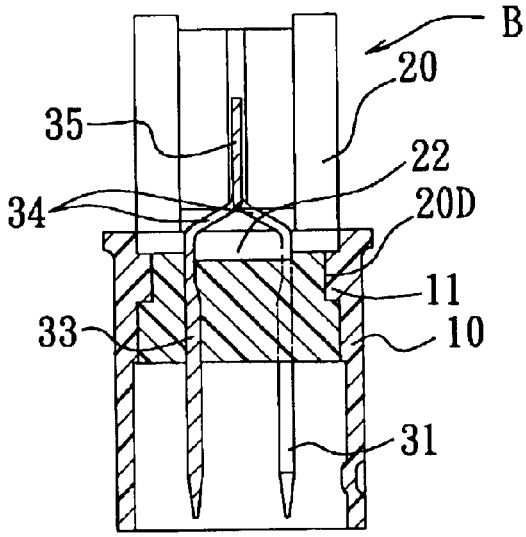
FIG. 5 is a sectional view taken along lines 5—5 of FIG. 4.

Before the present invention is described in greater detail, it should be noted that same reference numerals have been used to denote like elements throughout the specification.

Figure 6:
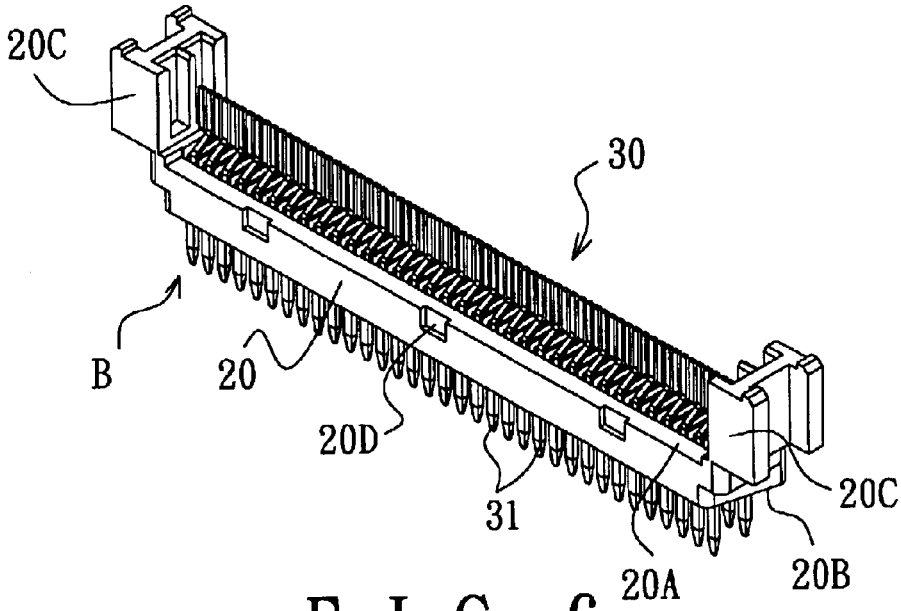
FIG. 6 is a perspective view of the terminal module of FIG. 4.
Figure 7:
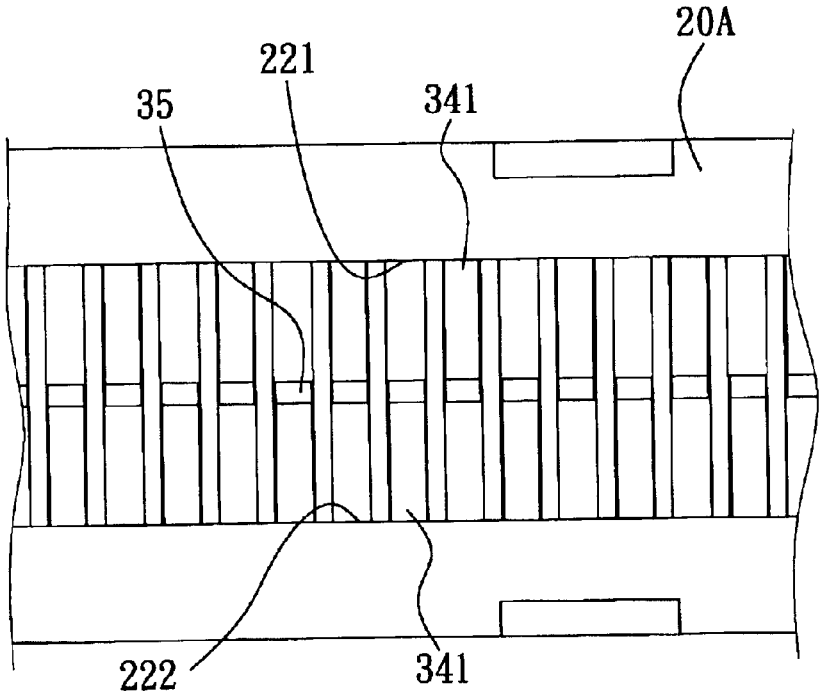
FIG. 7 is a fragmentary plan view of the terminal module.

Referring to FIGS. 3 to 8, a cable connector (A) embodying the present invention is shown to include a connector housing 10 and a terminal module (B) mounted inside the connector housing 10. As best shown in FIGS. 6 and 7, the terminal module (B) includes an insulative body 20 which has two opposed first and second faces 20A and 20B, and a plurality of spaced apart parallel ribs 21 formed in the first face 20A to confine grooves 22 therebetween. The insulative body 20 further has two opposed arm sections 20C projecting from the first face 20A at two longitudinally opposed ends thereof. An interengagement unit, which is composed of a plurality of recesses 20D formed in the insulative body 20 and tongues 11 formed on the inner wall of the connector housing 10, is used to interengage the connector housing 10 and the insulative body 20 when the insulative body 20 is inserted into the connector housing 10.

Referring again to FIGS. 5, 6, 7 and 8, the insulative body 20 is integrally molded, through an insert molding process, over a terminals set including two rows of terminals 30. Each terminal 30 includes a contact section 31, a retention section 33, and a tail section which is composed of a bent section 34 and a soldering section 35. The bent sections 34 of the terminals 30 extend respectively and obliquely from the retention sections 33, and the soldering sections 35 are bent respectively from the bent sections 34 to be coplanar with each other in a same plane. The insulative body 20 is molded over the retention sections 33 of two rows of the terminals 30 so that the retention sections 33 are retained within the insulative body 20. The contact sections 31 of the terminals 30 extend out of the insulative body 20 through the second face 20B. The bent sections 34 of the terminals 30 extend out of the insulative body 20 through the first face 20A. The parallel ribs 21 and grooves 22 extend between two rows of the bent sections 34. Each groove 22 has two opposed first and second ends 221, 222.

Figure 8:
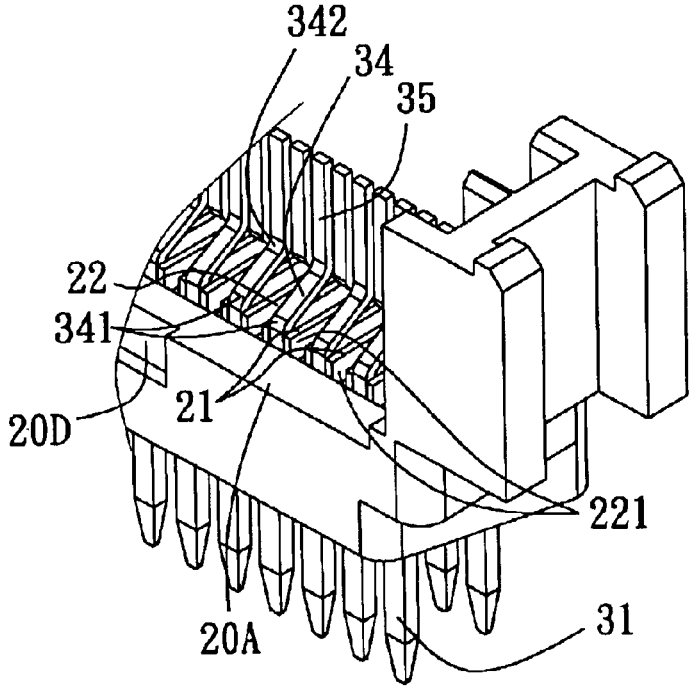
FIG. 8 is a fragmentary enlarged view of a portion of the terminal module.
Figure 9:
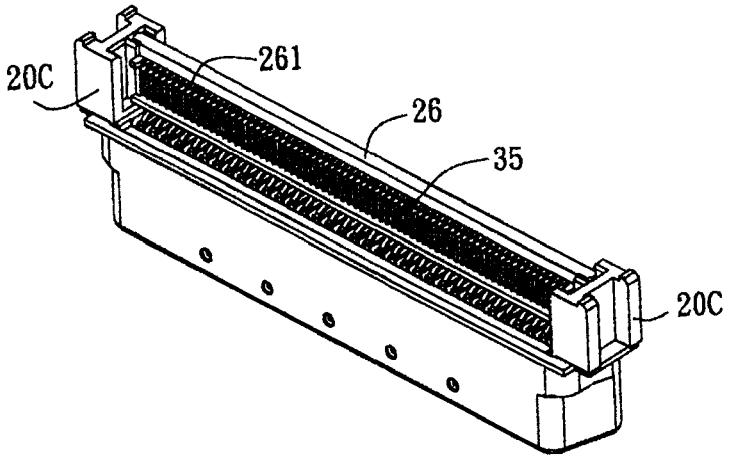
FIG. 9 is the same view as FIG. 4 but with a spacer plate being attached to two arm sections.

The bent sections 34 have respective proximal ends 341 adjacent to the first face 20A of the insulative body 20, and respective distal ends 342 extending away from the first face 20A and connected to the respective soldering sections 35. The bent sections 34 of the terminals 30 in one row are staggered with respect to the bent sections 34 in the other row along a direction transverse to the directions of the rows of the terminals 30. The bent sections 34 converge from the proximal ends 341 to the plane of the soldering sections 35. As best shown in FIGS. 7 and 8, the proximal ends 341 of two rows of the bent sections 34 are received alternately in the first and second ends 221, 222 of the grooves 22. Every other one of the first ends 221 of the grooves 22 receives one of the proximal ends 341 of the bent sections 34 in one row, whereas every other one of the second ends 222 of the grooves 22 receives one of the proximal ends 341 of the bent sections 34 in the other row. The ribs 21 between the grooves 22 serve to space the proximal ends 341 of the bent sections 34 from each other. As shown in FIG. 9, the soldering sections 35 are also spaced apart by using a spacer plate 26 which is inserted in between the two arm sections 20C. The spacer plate 26 is parallel and adjacent to the plane of the soldering sections 35 and has spacer elements 261 projecting therefrom to space the soldering sections 35 from each other.

Referring again to FIG. 3, the soldering sections 35 which are coplanar with each other are soldered respectively to wires 40 which are aligned in the same plane. With the coplanar configuration of the soldering sections 35, the wires 40 need not be separated into two rows.

Figure 10:
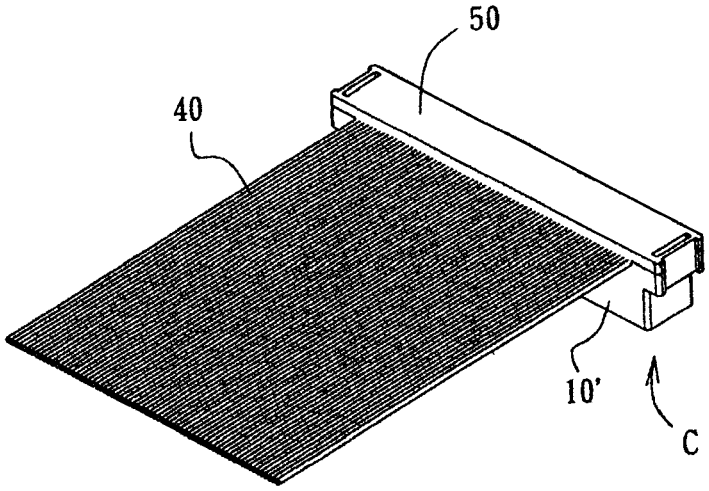
FIG. 10 is a perspective view of another cable connector embodying the present invention.
Figure 11:
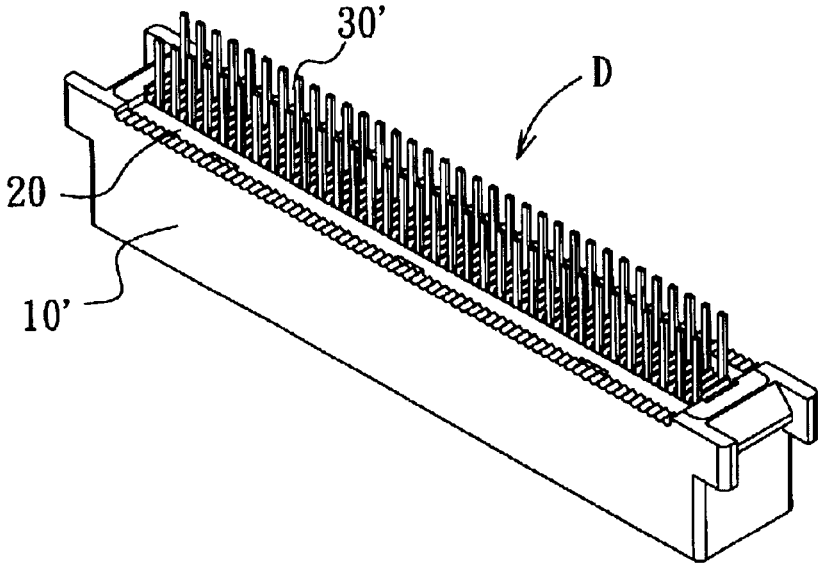
FIG. 11 is a perspective view of a terminal module mounted inside a connector housing of FIG. 10.
Figure 12:
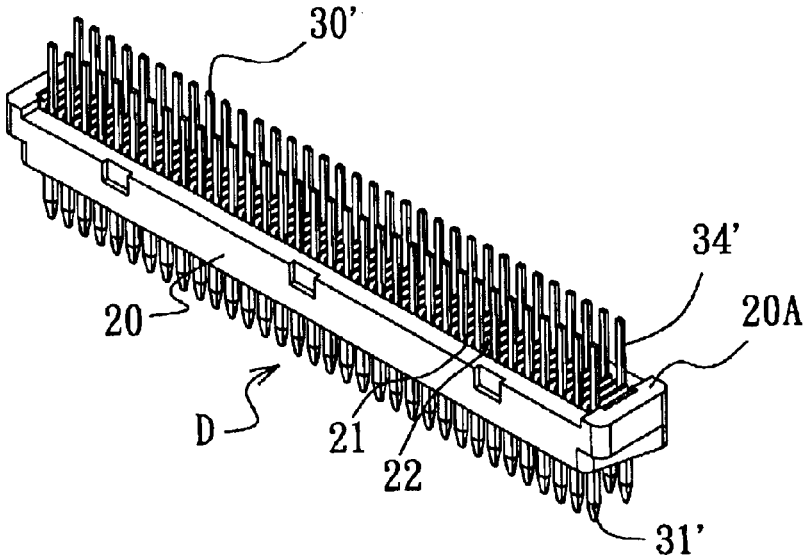
FIG. 12 is a perspective view of the terminal module of FIG. 11.

FIGS. 10, 11 and 12 show another cable connector (C) embodying the present invention, which includes a terminal module (D) mounted on a connector housing 10' for electrical connection with wires 40. A cover 50 is disposed over the wires 40 for protection purposes. The terminal module (D) includes an insulative body 20 which has the same configuration as the insulative body 20 of the previous embodiment. No arm sections are integrally formed with the insulative body 20. The insulative body 20 of the terminal module (D) is insert-molded over a terminals set including two rows of terminals 30'.

Each terminal 30' has a contact section 31', a retention section (not shown) retained within the insulative body 20 and a tail section 34' extending out of the insulative body 20 from the first face 20A of the insulative body 20. Ribs 21 and grooves 22 extend between two rows of the tail sections 34' of the terminals 30'. The tail sections 34' are staggered with respect to each other along a direction transverse to the direction of the rows of the tail sections 34'.

Figure 13:
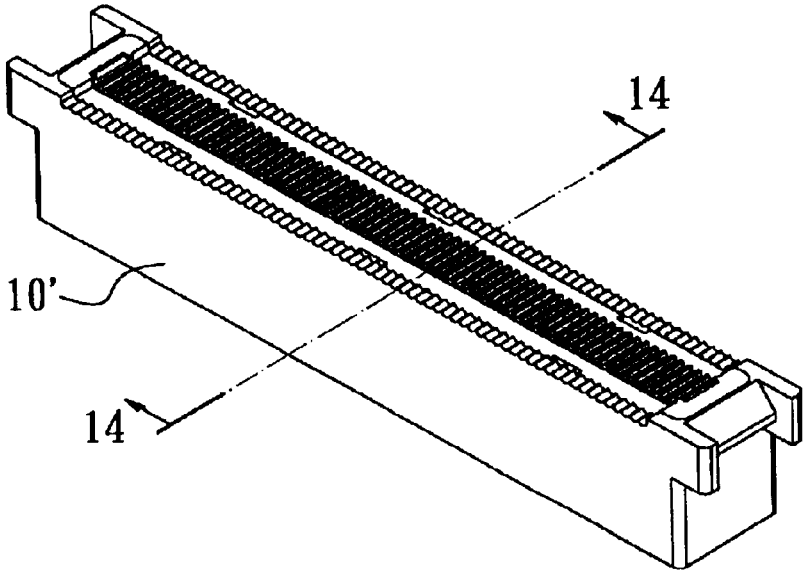
FIG. 13 is the same view as FIG. 11 but with the terminals being bent.
Figure 14:
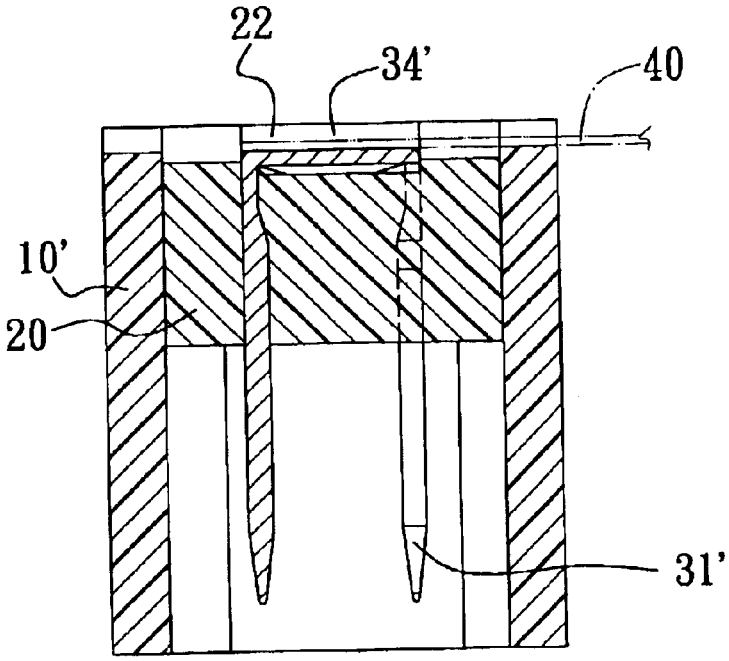
FIG. 14 is a sectional view taken along lines 14—14 of FIG. 13.

Referring to FIGS. 13 and 14 in combination with FIG. 11, the insulative body 20 is mounted inside the connector housing 10'. The two rows of tail sections 34' are bent toward each other at right angles and are received alternately within the respective grooves 22. The wires 40 are soldered to the respective tail sections 34' by disposing the end portions of the wires 40 within the respective grooves 22 over the tail sections 34'.

As described above, the insulative body 20 of the terminal module (D) shown in FIG. 12 has substantially the same configuration as the insulative body 20 of the terminal module (B) shown in FIG. 6 except that the insulative body 20 of the terminal module (D) is not provided with the arm sections 20C. According to the present invention, the insulative bodies 20 of the terminal modules (B) and (D) can be fabricated by using a common mold. In other words, the terminal modules (B) and (D) shown in FIGS. 6 and 12 can be produced by using a common mold.

Figure 15:
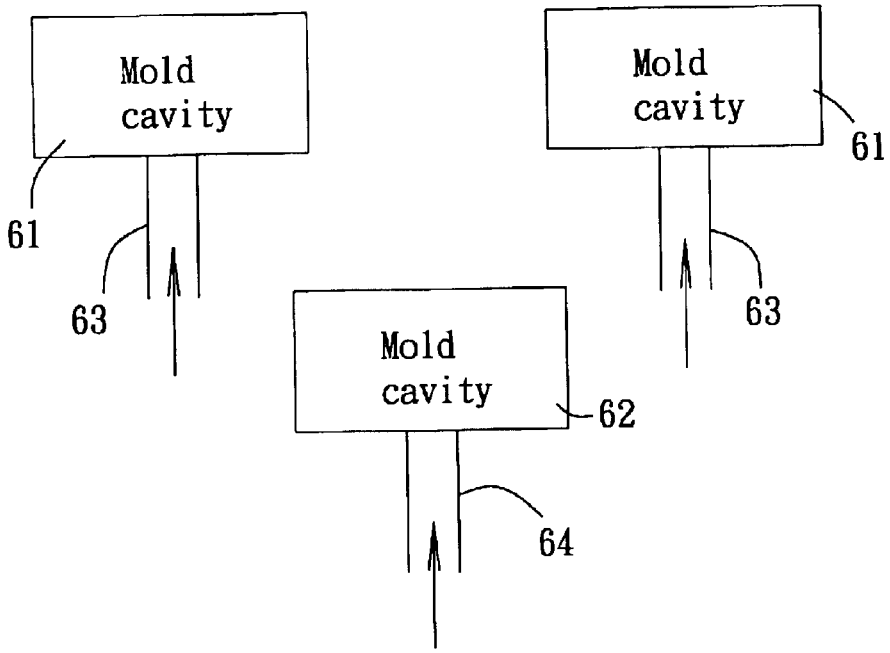
FIG. 15 is a block diagram illustrating an example of a process for fabricating terminal modules.

An example of a process for fabricating the insulative bodies 20 of the terminal modules (B) and (D) by using a common mold is described hereunder. As shown in FIG. 15, an example of the common mold includes two lateral mold cavities 61 for forming respectively the arm sections 20C and an intermediate cavity 62 for forming the insualtive body 20. The mold cavities 61 and 62 are respectively connected to flow passages 63 and 64 through which a molding material is fed. When all of the flow passages 63 and 64 are opened to an operative position to permit the molding material to flow into the mold cavities 61 and 62, the arm sections 20C are integrally formed with the insulaitve body 20. Thus, the terminal module (B) is produced. In case the terminal module (D) is to be produced, the arm sections 20*c* can be eliminated by blocking the flow passages 63 so that no material flows through the flow passages 63. As such, the molding material only fills the intermediate cavity 62 to form the insulaitve body 20. Details of the construction of the common mold are not provided herein since the construction thereof is irrelevant to the present invention.

In view of the aforesaid, the insulative body 20 the present invention can be used to produce the terminal modules (B) and (D) of the cable connectors (A) and (C). In other words, the present invention permits production of two different types of cable connectors by using a common mold, thereby reducing the production costs for manufacturing two types of cable connectors.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A cable connector comprising:

a cable having a plurality of wires;

a connector housing; and a terminal module mountable on said connector housing to establish an electrical connection with said wires, said terminal module including an insulative body having two opposed first and second faces, and a plurality of spaced apart parallel ribs formed in said first face and confining grooves therebetween, said insulative body being molded over two rows of terminals, wherein said terminals each include a retention section surrounded by said insulative body, and a tail section extending out of said insulative housing through said first face, said parallel ribs and grooves extending between said two rows of said tail sections, said grooves having first ends on the same side and second ends opposite to said first ends;

wherein said tail sections of said terminals include bent sections extending respectively from said retention sections, and soldering sections extending respectively from said bent sections and being coplanar with each other in a same plane, said soldering sections being soldered respectively to said wires, said bent sections having proximal ends adjacent to said first face and distal ends extending away from said first face and connected to said soldering sections, all of said bent sections converging from said proximal ends to said plane of said soldering sections, said proximal ends of said bent sections in one of said rows and said proximal ends of said bent sections in the other one of said rows alternately passing through said first and second ends of said grooves, every other one of said first ends of said grooves receiving one of said proximal ends of said terminals of one row, every other one of said second ends of said grooves receiving one of said proximal ends of said terminals of the other row, said proximal ends of said bent sections being spaced from each other by said ribs.

2. The cable connector as claimed in claim 1, wherein each of said terminals further includes a contact section extending from said retention section and projecting out of said insulative body through said second face.

3. The cable connector as claimed in claim 1, wherein said terminal module further comprises a pair of arm sections projecting from said first face at two opposed ends of said insulative body, and a spacer plate disposed between said arm sections, said spacer plate being parallel and adjacent to said plane of said soldering sections and having spacer elements projecting therefrom to extend between said soldering sections.

4. A cable connector comprising, a terminal module which includes a terminals set and an insulative body molded over said terminals set through an insert molding process, said insulative body having two opposed first and second faces, and a plurality of spaced apart parallel ribs formed in said first face and confining grooves therebetween, said terminals set being selected from a group consisting of a first terminals set and a second terminals set, each of said first and second terminals sets having two rows of terminals, said terminals including retention sections surrounded by said insulative body, and tail sections respectively extending from said retention sections, said tail sections extending out of said insulative body from said first face, said parallel ribs and grooves extending between said two rows of said tail sections, said grooves having first ends on the same side and second ends opposite to said first ends;

wherein said tail sections of said terminals of said first terminals set include bent sections extending respectively from said retention sections, and soldering sections extending respectively from said bent sections and being coplanar with each other in a same plane, said bent sections having proximal ends adjacent to said first face and distal ends extending away from said first face and connected to said soldering sections, all of said bent sections converging from said proximal ends to said plane of said soldering sections, said proximal ends of said bent sections in one of said rows and said proximal ends of said bent sections in the other one of said rows alternately passing through said first and second ends of said grooves, every other one of said first ends of said grooves receiving one of said proximal ends of said terminals of one row, every other one of said second ends of said grooves receiving one of said proximal ends of said terminals of the other row, said proximal ends of said bent sections being spaced from each other by said ribs, and wherein said two rows of said tail sections of said second terminals set are bent substantially at right angles and are alternately received in said grooves.

5. A cable connector as claimed in claim 4, further comprising a plurality of wires for electrical connection with said tail sections of said terminals, and a connector housing, said insulative body being mounted inside said connector housing.

* * * * *